US007749141B2

(12) United States Patent
Meisterling

(10) Patent No.: US 7,749,141 B2
(45) Date of Patent: Jul. 6, 2010

(54) TRAINING APPARATUS AND METHOD FOR USING THE SAME

(76) Inventor: Eric Meisterling, 646 Hall Hill Rd., Somers, CT (US) 06071

( * ) Notice: Subject to any disclaimer, the term of this patent is extended or adjusted under 35 U.S.C. 154(b) by 0 days.

(21) Appl. No.: 11/951,474

(22) Filed: Dec. 6, 2007

(65) Prior Publication Data

US 2009/0149303 A1 Jun. 11, 2009

(51) Int. Cl.
*A63B 21/02* (2006.01)

(52) U.S. Cl. ..... 482/121; 482/79; 482/148

(58) Field of Classification Search ..... None
See application file for complete search history.

(56) References Cited

U.S. PATENT DOCUMENTS

| | | | | | |
|---|---|---|---|---|---|
| 2,467,943 | A * | 4/1949 | Mikell, Jr. | 482/79 |
| 3,213,551 | A * | 10/1965 | Krauss | 36/102 |
| 3,256,015 | A * | 6/1966 | Perrin | 482/129 |
| 4,251,070 | A * | 2/1981 | Leseberg | 482/131 |
| 4,728,103 | A * | 3/1988 | Fulton | 482/125 |
| 5,518,486 | A * | 5/1996 | Sheeler | 482/131 |
| 5,593,374 | A * | 1/1997 | Gvoich | 482/123 |
| 5,645,516 | A * | 7/1997 | Foster | 482/79 |
| 5,941,802 | A * | 8/1999 | Kiser | 482/92 |
| 6,206,807 | B1 * | 3/2001 | Cowans et al. | 482/79 |
| 6,361,517 | B1 * | 3/2002 | Slinger | 602/28 |
| 7,087,003 | B1 * | 8/2006 | Katterjohn | 482/124 |
| 7,125,392 | B2 * | 10/2006 | Scott | 602/23 |
| 7,354,413 | B2 * | 4/2008 | Fisher | 602/29 |
| 7,444,768 | B2 * | 11/2008 | Friton | 36/50.1 |
| 2006/0183609 | A1 * | 8/2006 | Flynn | 482/124 |
| 2007/0060454 | A1 * | 3/2007 | Vogel | 482/121 |
| 2008/0009398 | A1 * | 1/2008 | Grisdale | 482/124 |
| 2008/0058180 | A1 * | 3/2008 | Clarke et al. | 482/126 |
| 2008/0139369 | A1 * | 6/2008 | Vigilia | 482/124 |

* cited by examiner

*Primary Examiner*—Lori Baker
(74) *Attorney, Agent, or Firm*—Cantor Colburn LLP

(57) ABSTRACT

A kick training apparatus includes; a foot-receiving receptacle, which receives at least a front portion of a foot, and a band including a first end coupled to the foot-receiving receptacle, wherein a second end of the band is configured to be restrained by a hand.

12 Claims, 4 Drawing Sheets

TRAINING APPARATUS AND METHOD FOR USING THE SAME

BACKGROUND OF THE INVENTION

1. Field of the Invention

The present invention relates generally to an apparatus for training a user to strengthen and maintain a proper kicking motion, and a method for using the same, and more particularly to a soccer kick training apparatus which may be used by a solitary individual in a small amount of space.

2. Description of the Related Art

The sport of soccer, while already the most popular sport worldwide, is rapidly gaining a large following in the United States. Along with the increase in popularity there is an increased need for training the newfound enthusiasts in the proper fundamentals and mechanics of the sport. While soccer is primarily a team sport involving many participants there is a need for an apparatus and method which allows an individual to practice on his or her own to refine soccer skills.

Many different types of soccer training devices are known in the art. The majority of these devices rely on the use of a soccer ball which is tethered to the individual in various ways. With such devices the user kicks the soccer ball which is then returned via the tethering apparatus. These devices have several drawbacks including the need for a large amount of open space in which to practice and possibly erratic return paths for the soccer ball depending upon the tethering location, e.g., if the soccer ball is tethered to the user's wrist the return path will be affected by the user's arm movement. In addition, such devices require the purchase of additional equipment, namely a ball, before they may be used. Furthermore, these devices do nothing to foster a correct kicking movement in which the foot is extended away from the rest of the leg and the top of the foot contacts the ball.

Another type of soccer training device relies on an elastic strap which is connected to a user's foot on one end and connected to an anchor sunk into the ground on the other end. This device eliminates the need to purchase an additional ball, and also eliminates problems associated with erratic ball return. However, this type of device still requires a large amount of room, e.g., at least as much room as required to stake the anchor and extend the elastic strap to a proper distance to provide resistance, and a somewhat lengthy set-up time is necessary. Furthermore, this device does not foster a correct kicking position in which the foot is extended away from the leg and the top of the foot contacts the ball.

Furthermore, there are many different activities, other than soccer, which require strong and accurate kicking skills (e.g., football and martial arts such as karate). The training apparatuses for such activities typically suffer from the same limitations as the soccer training apparatuses described above in that they require a large amount of open space and a lengthy set-up time.

Accordingly, it is desirable to provide an apparatus and method which strengthens kicking muscles while promoting a correct kicking position, and which does so in a limited amount of space, and with a minimal amount of set-up time.

BRIEF SUMMARY OF THE INVENTION

The foregoing discussed drawbacks and deficiencies of the prior art are overcome or alleviated, in one exemplary embodiment, by an apparatus which includes; a foot-receiving receptacle, which receives at least a front portion of a foot, and a band including a first end coupled to the foot receiving receptacle, wherein a second end of the band is configured to be restrained by a hand.

In one exemplary embodiment the foot-receiving receptacle is a pocket.

In one exemplary embodiment the pocket includes; a first flap, and a second flap, wherein the first flap and the second flap are joined along a portion of their periphery to form a receptacle having an open end.

In one exemplary embodiment the first flap is smaller than the second flap.

In one exemplary embodiment the first end of the band is coupled to the second flap.

In one exemplary embodiment the foot-receiving receptacle includes a mesh material.

In one exemplary embodiment the band comprises a resilient material.

In one exemplary embodiment the band includes an elastomer.

In one exemplary embodiment the band is a material selected from the group consisting of elastic and rubber.

In one exemplary embodiment the band includes rope.

In one exemplary embodiment the apparatus further comprises a handle coupled to the second end of the band.

In one exemplary embodiment the handle includes a strap having a first end and a second end, wherein the first end and the second ends are connected to the band.

In one exemplary embodiment the apparatus further includes; a tab connected to an end of the foot-receiving receptacle, and a ring which passes through the tab, wherein the first end of the band is coupled to the foot-receiving receptacle via the ring.

In one exemplary embodiment the first end of the band is threaded through the ring and is then looped back onto itself and fixed in position.

According to another exemplary embodiment of the present invention, a method for kick training includes; inserting a foot of a user into a foot-receiving receptacle, grasping a handle which is coupled to the foot receiving receptacle by a band, creating a tension in the band, and extending the knee with hip flexion against the tension of the band while the foot is in plantar flexion.

In one exemplary embodiment the step of creating tension in the band further includes; raising the foot to an elevated position behind the user, positioning at least a portion of the band behind the user, grasping the handle in front of the user, and pulling on the handle.

In one exemplary embodiment the action of extending the knee with hip flexion against the tension of the band while the foot is in plantar flexion includes; moving the foot from behind the user to a position in front of the user by extending the knee with hip flexion while maintaining the foot in plantar flexion, wherein an obtuse angle is formed between the foot and a lower leg of the user.

BRIEF DESCRIPTION OF THE DRAWINGS

Referring to the exemplary drawings wherein like elements are numbered alike in the several Figures.

DETAILED DESCRIPTION OF THE INVENTION

Disclosed herein is an apparatus for strengthening and conditioning kicking muscles while fostering a correct kicking position which does so in a limited amount of space and with a minimal amount of set-up.

Figure 1:
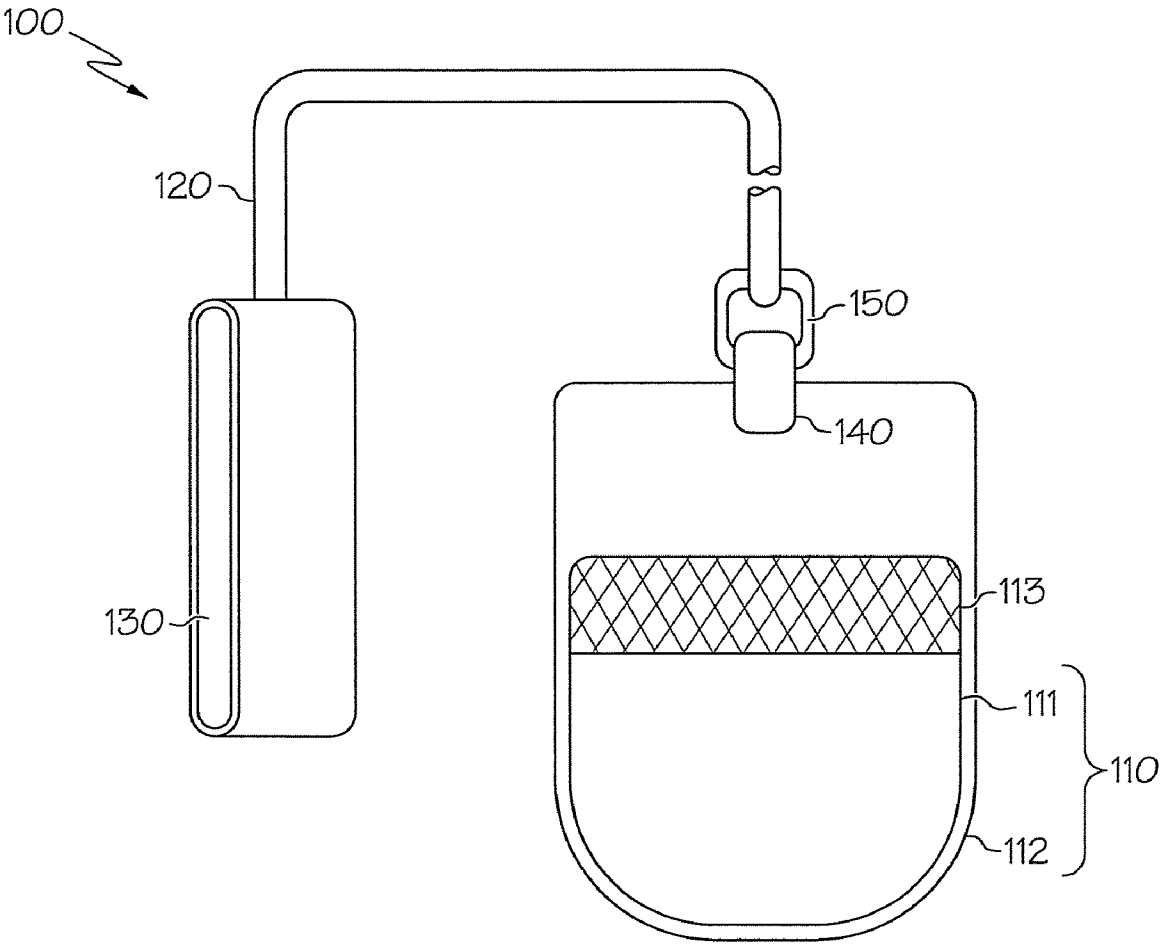
FIG. 1 is a top perspective view of an exemplary embodiment of a training apparatus according to the present invention.

Referring now to FIG. 1, there is shown a top perspective view of an exemplary embodiment of a training apparatus according to the present invention.

As shown in FIG. 1, an exemplary embodiment of a training apparatus 100 includes a foot-receiving receptacle 110, a band 120 and a handle 130.

The foot-receiving receptacle 110 serves as a receptacle for at least a front portion of a user's foot. The front portion of the foot may include the phalanges and portions of the metatarsals and also may include the portion of the foot which is substantially opposite the sole. In the current exemplary embodiment the foot-receiving receptacle 110 is a pocket formed from a first flap 111 and a second flap 112. The two flaps 111 and 112 are connected to each other along a portion of their periphery while leaving one side open to form the foot-receiving receptacle 110. The connection may be made by any of several well-known techniques including adhesives or sewing the edges together. Alternative exemplary embodiments include configurations wherein the foot-receiving receptacle 110 may be formed from a single piece or formed from a multitude of individual pieces.

Although the current exemplary embodiment has been described with the foot-receiving receptacle 110 as a pocket shape, the foot-receiving receptacle 110 may be any configuration which receives at least the front portion of the user's foot. Alternative exemplary embodiments include configurations wherein the foot-receiving receptacle 110 is shaped like a shoe. Alternative exemplary embodiments also include configurations wherein the foot-receiving receptacle 110 includes a strap encircling the front portion of the user's foot and a second strap for connecting with the band 120.

In the current exemplary embodiment the first flap 111 includes a mesh portion 113 which allows for additional airflow to the foot of the user when inserted into the foot-receiving receptacle 110. Alternative exemplary embodiments include configurations wherein both flaps 111 and 112 include mesh portions. Additional alternative exemplary embodiments include configurations wherein the mesh portion 113 is omitted.

In the current exemplary embodiment the first flap 111 is substantially smaller than the second flap 112. This allows the user to insert their foot into the foot-receiving receptacle 110 while providing additional space between the foot and a tab 140 for connection to the band 120. Alternative exemplary embodiments include configurations wherein the first and second flaps 111 and 112 are substantially similar in size.

In the current exemplary embodiment the tab 140 is disposed on the second flap 112 and serves as a connecting point for the band 120. In the current exemplary embodiment the tab 120 is formed from a loop of rip-resistant fabric. A ring 150 is disposed inside of the loop of the tab 120. One end of the band 120 is then coupled to the ring 150. In the current exemplary embodiment the end of the band 120 is threaded through the ring 150 and is then looped back onto itself where it is fixed in position, e.g., by sewing it together. This allows the end of the band 120 to freely move along the ring 150 thereby ensuring smooth operation of the apparatus 100. Alternative exemplary embodiments include configurations wherein one end of the band 120 is connected directly to the foot-receiving receptacle 110.

In the current exemplary embodiment the band 120 extends from the ring 150 to the handle 130. The band 120 provides tension to the foot-receiving receptacle 110. The user feels this tension as a resistive force while making a kicking motion with the foot inserted in the foot-receiving receptacle 110. In one exemplary embodiment the band 120 includes a resilient material such as an elastomer. Exemplary embodiments of elastomers include rubber and elastic. Alternative exemplary embodiments include configurations wherein the band 120 may be made of rope.

The band 120 is connected to the handle 130. In one exemplary embodiment the handle 130 is a strap of material which is joined at each of its ends to form a loop which may be held by the user. In such an exemplary embodiment the ends of the strap may be joined with the band 120 so that the connection with the band 120 is formed at substantially the same position as the connection of the ends of the strap. Such an exemplary embodiment provides the additional advantage of eliminating a step in the manufacturing process of the apparatus 100. Alternative exemplary embodiments include configurations wherein the handle 130 is differently shaped and differently connected to the band 120.

Referring now to FIGS. 2, 3A-C and 4 there is shown a front perspective view of a user 200 in a first step of an exemplary embodiment of a method of utilizing the exemplary embodiment of a training apparatus 100 of the present invention, side prospective views illustrating first through third steps of the exemplary embodiment of a method of utilizing the exemplary embodiment of an apparatus 100 of the present invention and a schematic view illustrating the user 200's body motion in the first through third steps of the exemplary embodiment of the method of utilizing the exemplary embodiment of an apparatus 100 according to the present invention, respectively.

Figure 2:
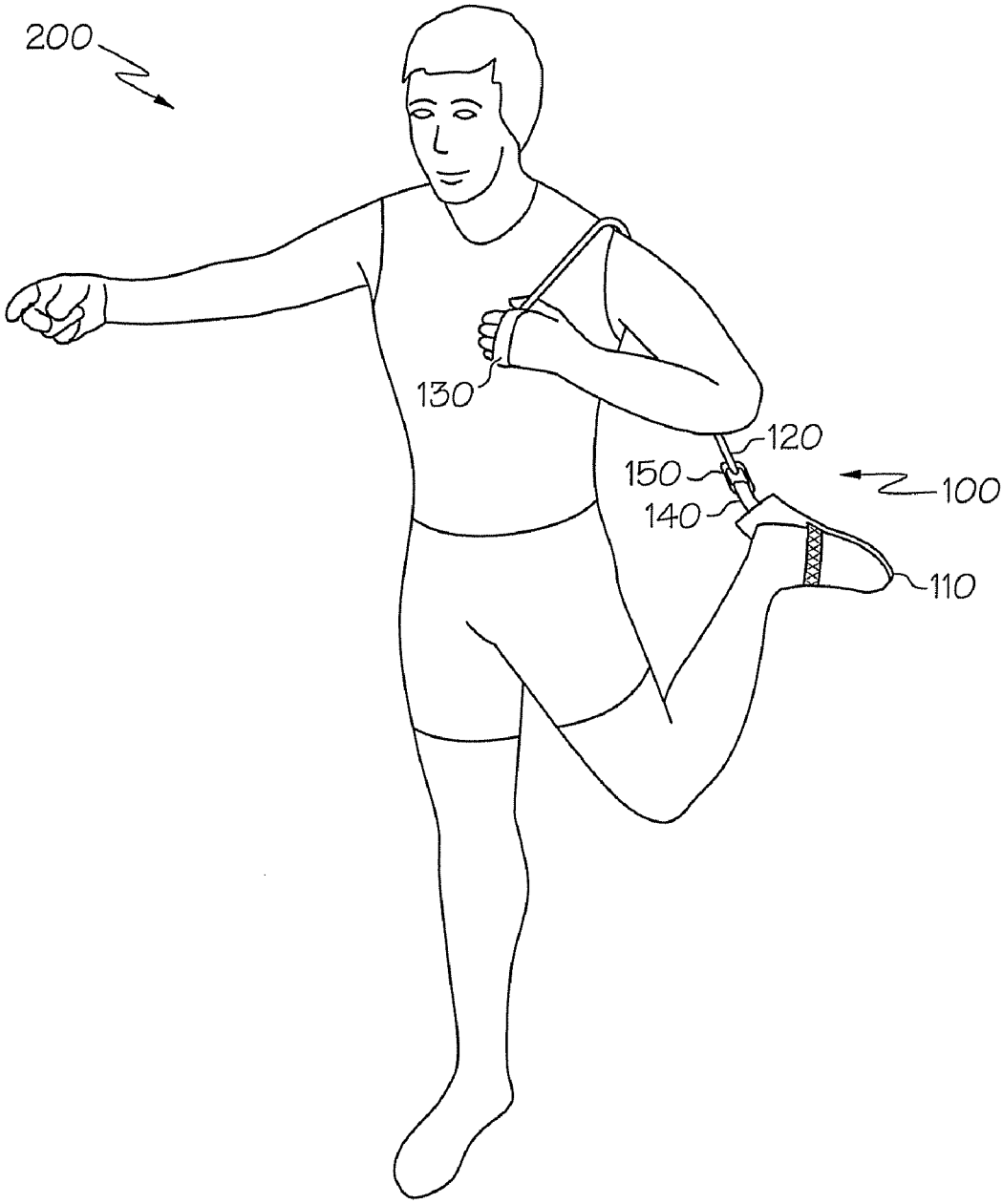
FIG. 2 is front perspective view of a user in a first step of an exemplary embodiment of a method of utilizing the exemplary embodiment of a training apparatus of the present invention.
Figure 3A:
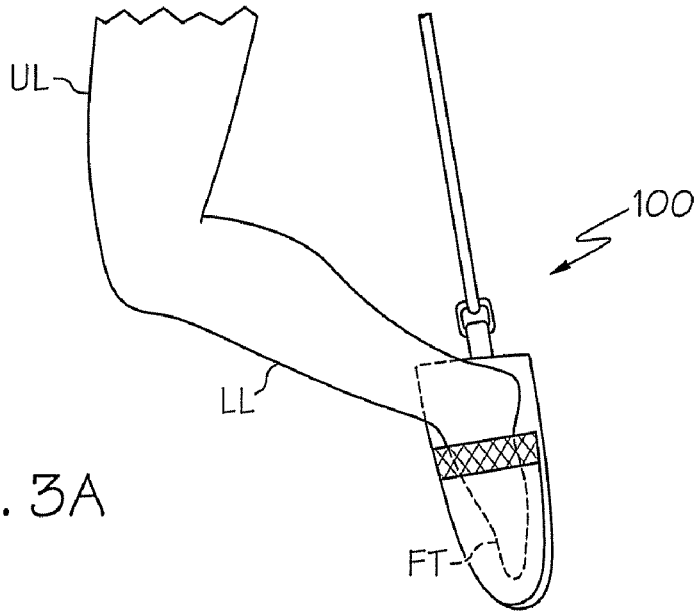
FIGS. 3A-C are side perspective views illustrating first through third steps of the exemplary embodiment of a method of utilizing the exemplary embodiment of an apparatus of the present invention.

As shown in FIGS. 2 and 3A in the first step of an exemplary embodiment of a method of utilizing the exemplary embodiment of an apparatus 100 of the present invention the user 200 inserts a foot (FT) into the foot-receiving receptacle 110. The user 200 then raises the inserted foot (FT) and positions the foot behind him. At this point the user's upper leg (UL), lower leg (LL) and foot (FT) are in a position which mirrors the first step of a desired kicking stance. The user 200 grips the handle 130 and creates tension in the band 120 by pulling the handle 130. In one exemplary embodiment the handle 130 may be pulled from over the shoulder of the user 200 with one hand as shown in FIG. 2, although alternative exemplary embodiments include configurations wherein the user 200 may use both hands or pull the handle from a different position.

Figure 3B:
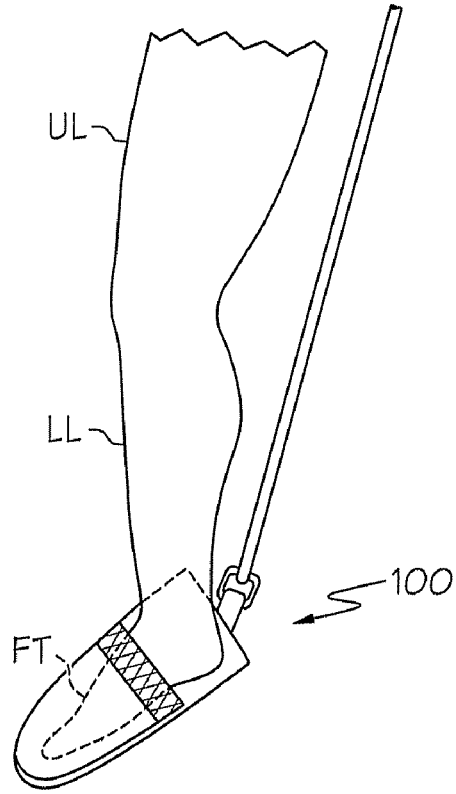

As shown in FIG. 3B, the user 200 then flexes the hip by moving the upper leg UL forward, extends the knee by straightening the lower leg LL while maintaining the foot FT down in plantar flexion into a position which mirrors a second step of a desired kicking stance. Plantar flexion is an extension of the ankle resulting in the forefoot moving away from the body. The tension in the band 120 pulls the foot-receiving receptacle 110 in a direction substantially opposite to the forward direction of the foot FT. This positioning mirrors the correct stance for a soccer kick wherein the top of the foot FT may contact a soccer ball.

Figure 3C:
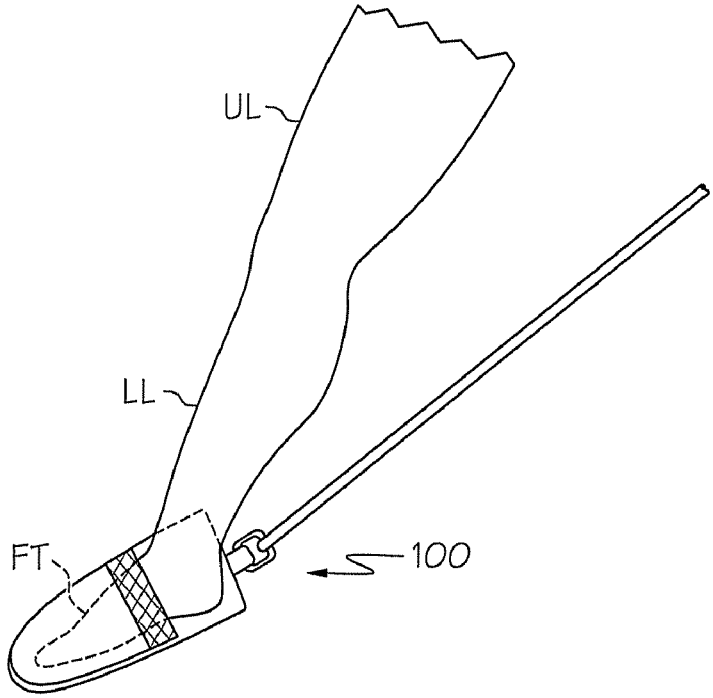

As shown in FIG. 3C, the user 200 then flexes the hip by moving the upper leg UL forward, extends the knee by straightening the lower leg LL while maintaining the foot FT forward in plantar flexion into a position which mirrors a third step of a desired kicking stance. The tension in the band 120 again pulls the foot-receiving receptacle 110 in a direction substantially opposite to the forward direction of the foot FT. This positioning mirrors the correct stance for a soccer kick wherein the foot follows through with the initial contact with the soccer ball.

Figure 4:
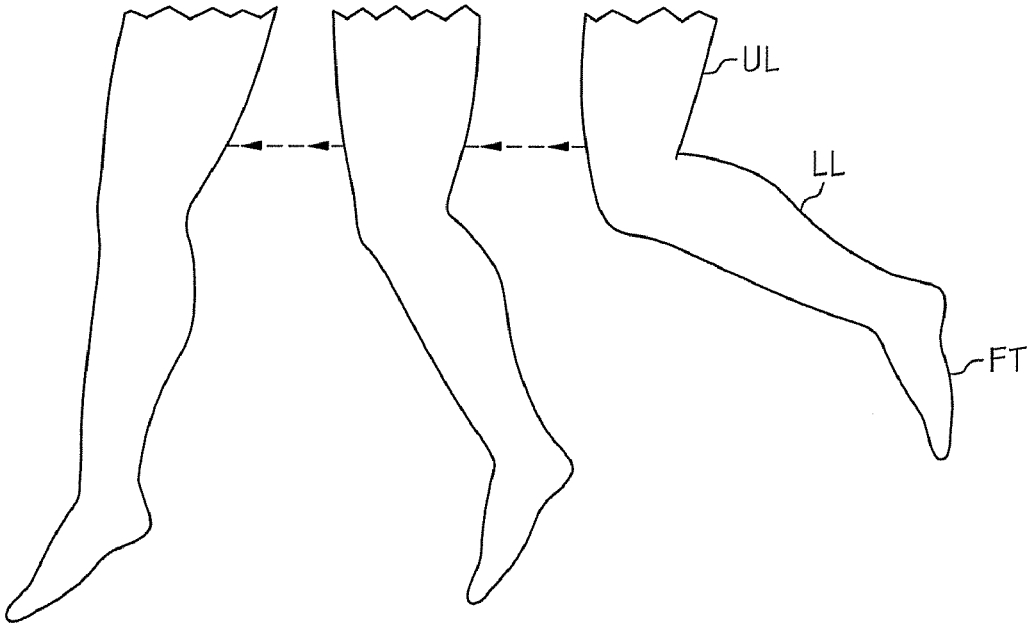
FIG. 4 is a schematic view illustrating the user's body motion in the first through third steps of the exemplary embodiment of the method of utilizing the exemplary embodiment of the present invention.

FIG. 4 illustrates the various angles made between the different components of a user 200's leg during the first through third steps described above. The angle between the user 200's foot FT and lower leg LL is always obtuse, which indicates that the foot is in the correct position exhibiting plantar flexion.

Through repeated use the user 200 may develop a muscle memory of the correct kicking stance and execution and may also develop improved muscle strength which will translate into improved performance in actual sporting events for which kicking is central to successful execution. The user 200 may achieve this improved performance by practicing with the apparatus 100 in a relatively small area, either indoors or outdoors, with minimal set-up.

While exemplary embodiments of the present invention have been described especially in relation to soccer training, the present invention is not limited thereto, but instead may be applied to training for any activity which requires powerful and accurate kicking motions. The present invention may be readily applied to training for such diverse activities as martial arts, football, swimming and rock-climbing.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A kick training apparatus comprising:

a foot-receiving receptacle, which receives both a front portion of a foot and a heel portion of a foot, the foot-receiving receptacle including a first end disposed adjacent to the front portion of the foot once received, and a second end disposed adjacent to the heel portion of the foot once received;

a band including a first end coupled to the foot-receiving receptacle; and a tab connected to the second end of the foot-receiving receptacle, wherein the first end of the band is coupled to the foot-receiving receptacle via the tab at the second end of the foot-receiving receptacle, wherein a second end of the band is configured to be restrained by a hand, and wherein the foot-receiving receptacle comprises a pocket and the pocket comprises:

a first flap; and a second flap, wherein the fist flap and the second flap are joined along a portion of their periphery to form a receptacle having an open end.

2. The apparatus of claim 1, wherein the first flap is smaller than the second flap.

3. The apparatus of claim 2, wherein the first end of the band is coupled to the second flap.

4. The apparatus of claim 1, wherein the foot-receiving receptacle comprises a mesh material.

5. The apparatus of claim 1, wherein the band comprises a resilient material.

6. The apparatus of claim 5, wherein the band comprises an elastomer.

7. The apparatus of claim 1, wherein the band is a material selected from the group consisting of elastic and rubber.

8. The apparatus of claim 1, wherein the band comprises a rope.

9. The apparatus of claim 1, further comprising a handle coupled to the second end of the band.

10. The apparatus of claim 9, wherein the handle comprises:

a strap having a first end and a second end, wherein the first and second ends are connected to the band.

11. The apparatus of claim 1, further comprising:

a ring which passes through the tab, wherein the first end of the band is coupled to the ring.

12. The apparatus of claim 11, wherein the first end of the band is threaded through the ring, looped back onto itself and fixed in position.

* * * * *